US008955790B2

(12) United States Patent
Jokitalo et al.

(10) Patent No.: US 8,955,790 B2
(45) Date of Patent: Feb. 17, 2015

(54) DISPENSER

(75) Inventors: Joonas Jokitalo, Borlange (SE); Pentti Jokitalo, legal representative, Borlange (SE); Per Moller, Falun (SE); Bjorn Larsson, Billdal (SE)

(73) Assignee: SCA Hygiene Products AB, Gothenburg (SE)

( * ) Notice: Subject to any disclaimer, the term of this patent is extended or adjusted under 35 U.S.C. 154(b) by 862 days.

(21) Appl. No.: 13/132,114

(22) PCT Filed: Dec. 1, 2009

(86) PCT No.: PCT/EP2009/066163

§ 371 (c)(1),
(2), (4) Date: Aug. 17, 2011

(87) PCT Pub. No.: WO2010/063727

PCT Pub. Date: Jun. 10, 2010

(65) Prior Publication Data

US 2012/0036975 A1 Feb. 16, 2012

(30) Foreign Application Priority Data

Dec. 1, 2008 (SE) ..... 0802502

(51) Int. Cl.
*B65H 16/10* (2006.01)
*A47K 10/36* (2006.01)

(52) U.S. Cl.
CPC ..... *A47K 10/36* (2013.01)
USPC ..... 242/564.4; 242/564; 242/564.2

(58) Field of Classification Search
CPC ..... A47K 10/32; A47K 10/34; A47K 10/36; A47K 10/3606; A47K 10/3612; B65H 20/02; B65H 20/04; B65H 16/08
USPC ..... 242/564, 564.1, 564.2, 564.3, 564.4, 242/565, 563, 563.1, 563.2
See application file for complete search history.

(56) References Cited

U.S. PATENT DOCUMENTS

| | | | |
|---|---|---|---|
| 2,622,873 | A | 12/1952 | Wenneche |
| 3,107,957 | A | 10/1963 | Batlas et al. |

(Continued)

FOREIGN PATENT DOCUMENTS

| | | | |
|---|---|---|---|
| CN | 1551739 | A | 12/2004 |
| EP | 0 010 404 | A1 | 4/1980 |
| EP | 1 405 590 | A1 | 4/2004 |
| WO | 97/24970 | A1 | 7/1997 |
| WO | 2005/096903 | A1 | 10/2005 |
| WO | WO-2007/098419 | | 8/2007 |

(Continued)

OTHER PUBLICATIONS

International Search Report, dated Mar. 8, 2010, from corresponding PCT application.

(Continued)

*Primary Examiner* — William A Rivera
(74) *Attorney, Agent, or Firm* — Drinker Biddle & Reath LLP

(57) ABSTRACT

A dispenser for dispensing wiping material through a dispensing opening, includes an outer, first housing for holding at least one roll containing a continuous web of wiping material. The first housing may further hold an inner, cassette including at least a front wall and two side walls, the cassette at least partially enclosing a feeding unit for controlling the dispensing of the web. The feeding unit includes at least a drive roller, a pressure roller and a cutting device, and the web is arranged to be fed from the roll and into the feeding unit. The cassette includes an at least partially removable hatch, which hatch, when opened, is arranged to provide access to the feeding unit.

20 Claims, 5 Drawing Sheets

(56) References Cited

U.S. PATENT DOCUMENTS

| | | | | |
|---|---|---|---|---|
| 3,459,353 | A | 8/1969 | Taylor | |
| 3,924,476 | A | 12/1975 | Wolcott | |
| 5,836,862 | A * | 11/1998 | Granger | 493/459 |
| 6,196,102 | B1 | 3/2001 | Granger | |
| 6,591,727 | B1 | 7/2003 | Purcell et al. | |
| 7,234,381 | B2 | 6/2007 | Granger | |
| 7,530,524 | B2 * | 5/2009 | Wieser et al. | 242/564.4 |
| 7,837,077 | B2 * | 11/2010 | Formon et al. | 225/6 |
| 7,878,445 | B2 | 2/2011 | Granger et al. | |
| 8,082,828 | B2 * | 12/2011 | Formon et al. | 83/649 |
| 2002/0005685 | A1 | 1/2002 | Granger | |
| 2003/0167893 | A1 | 9/2003 | Morris et al. | |
| 2004/0108406 | A1 * | 6/2004 | Friesen | 242/564.4 |
| 2007/0029435 | A1 | 2/2007 | Moody et al. | |
| 2007/0228208 | A1 * | 10/2007 | Wieser et al. | 242/564.4 |
| 2007/0234868 | A1 * | 10/2007 | Formon et al. | 83/649 |
| 2008/0283546 | A1 | 11/2008 | Neveu et al. | |

FOREIGN PATENT DOCUMENTS

| | | | |
|---|---|---|---|
| WO | 2007/126557 | A2 | 11/2007 |
| WO | WO-2008042961 | A2 | 4/2008 |
| WO | 2008/107601 | A1 | 9/2008 |

OTHER PUBLICATIONS

Chinese Office Action dated Jul. 10, 2013 issued in corresponding Chinese patent application No. 200980148367.5 (and English translation thereof) (13 pages).

Colombian Examination Report dated Jun. 11, 2013 issued in corresponding Colombian patent application No. 11-67781-7 (7 pages).

Examination Report dated Apr. 23, 2014 that issued in corresponding Mexico Patent Application No. MX/a/2011/005154.

International-Type Search Report that issued in Swedish Patent Application No. 0802502-5 on May 29, 2009.

* cited by examiner

DISPENSER

TECHNICAL FIELD

The invention relates to the technical field of dispensers for wipe materials with automatic, semi-automatic or manual dispensing which dispensers have applications for paper hand wipes, general-purpose paper wipes, toilet paper and similar wipes. The invention relates to the technical field of wipe dispensers for materials with automatic, semi-automatic or manual dispensing dispensers which have applications for paper hand wipes, general-purpose paper wipes, toilet paper and similar wipes.

BACKGROUND ART

In conventional sheet dispensing apparatus, material from a supply roll or stack of absorbent material is incrementally dispensed through a dispensing opening in a housing. Some dispensers are provided with a feeding mechanism, wherein the sheets may pass between a drive roller and a pinch roller, while still connected to the supply roll and are then dispensed through the dispensing opening. A cutting device may be arranged adjacent the dispensing opening to separate the lengths of material from the supply roll upon dispensing.

A problem with conventional devices is that the material may become jammed in the feeding mechanism, for instance in the nip area between the drive roller and the pinch roller. This requires the device to be serviced to remove the jam before the dispenser can properly continue dispensing material. Removing the jam may involve opening the entire dispenser cover in order to access the feeding mechanism, as shown in e.g. EP 1 405 590. A problem with this arrangement is that the feeding mechanism is exposed, which increase the risk of injuries to an operator inadvertently coming into contact with moving parts in the feeding mechanism during servicing.

In order to solve these problems, a dispenser may be provided with some form of outer casing, partially to protect the feeding mechanism from external action and partially to avoid injuries to an operator inadvertently coming into contact with moving or cutting component parts in the feeding mechanism during servicing. A dispenser of this type is shown in e.g. WO 07/126557.

A problem with this arrangement is that the feeding mechanism may comprise a protective outer casing, at least partially enclosing the feeding mechanism. Such a casing will provide protection for an operator during servicing, but will make servicing of the feeding mechanism and removal of a paper jam more complicated.

Hence, an object of the invention is to solve the above problems by providing an improved dispenser having means for facilitating access for servicing of the dispenser. A further object is to provide means for facilitating access for servicing of the dispenser with maintained operator safety and protection for the feeding mechanism.

DISCLOSURE OF INVENTION

The above problems are solved by a dispenser according to the appended claims.

In the subsequent text, the term "housing" is defined as a collective term for all components forming the outer shell of a dispenser or of an enclosed portion thereof. Hence, an outer housing may be considered to comprise component parts such as a chassis, which may comprise means for mounting the dispenser on a wall and be used for attaching internal components, and one or more outer walls, such as a front wall, side walls and a pivoted or removable cover allowing refilling of the dispenser. One or more outer walls may be a part of the chassis or be mounted separately as one or more units. Alternatively, the cover may make up a major part of the front wall or the front wall and side walls. The front wall may be defined as including the front and upper portions of the dispenser housing. In addition, an outer housing may comprise a an inner housing in the form of a casing or cassette enclosing at least part of a feeding mechanism for the material to be dispensed, which casing or cassette can be mounted to the chassis separate from the outer walls. An inner housing may comprise component parts, such as a front wall, side walls According to a preferred embodiment, the invention relates to a dispenser for dispensing wiping material through a dispensing opening. The dispenser may comprise an outer, first housing for holding at least one roll containing a continuous web of wiping material. The first housing further comprises at least a chassis, an outer front wall and two outer side walls. The first housing may also comprise an at least partially removable cover, which cover, when opened, is arranged to provide access to said at least one roll. The cover may comprise at least a major portion of the outer front wall, but may also include all of or parts of an upper portion of the front wall and/or one or more of the side walls of the first housing. The cover is preferably, but not necessarily opened outwards and downwards relative to the dispenser when mounted on a wall or similar. The first housing may further hold an inner, second housing comprising at least a front wall and two side walls. The second housing may at least partially enclose a feeding means for controlling the dispensing of the web through the dispensing opening. The feeding means comprises at least a drive roller, a pressure roller and, if required, a cutting device. The cutting device may be a stationary tear or cutter bar located adjacent the dispensing opening or a rotary cutter located in an axial slot in a drive roller or a rotary drum. The web of wiping material is arranged to be fed from a first roll and into the feeding means for subsequent dispensing out of the dispensing opening. In addition, the second housing comprises an at least partially removable hatch, which hatch, when opened, is arranged to provide access to the feeding means through an opening in the second housing.

The hatch may be pivotably mounted relative to the front wall of the second housing, wherein the said hatch may be supported by pivoting means such as opposing or facing pivots in the side walls of the second housing or a hinge arrangement mounted along one side edge of the hatch. The hatch may be arranged to be pivoted or hinged about a horizontal or a vertical axis. The pivots may be sequentially releasable from the side walls of the cassette, in that one pivot is released before the other pivot in a predetermined order. Alternatively, the pivots may be simultaneously releasable from the side walls of the cassette. In the above examples, the hatch is preferably opened to allow the pivots to be released. The degree of opening of the hatch required to allow release of the pivot may vary between fully open and substantially closed, depending on the shape of the hatch and the design of the attachments for the pivots.

The hatch is held in its closed position by at least one releasable attachment means, such as a snap-in connector, a magnetic device or a suitable manually releasable locking device.

The hatch may also be attached to the second housing by means of one or more releasable snap-in connectors. The hatch may for instance be positioned with one edge in contact with a cooperating edge of the opening in the second housing. These edges may be provided with cooperating lugs, recesses or similar. The opposite edge of the hatch may then be attached to the second housing adjacent the opposite edge of the opening in the second housing by means of at least one snap-in connector. The hatch may also be attached by two or more snap-in connectors only. In particular, the hatch may be mounted by means of snap-in connectors in opposing or facing recesses in the side walls of the second housing on either side of the opening in the second housing.

In order to provide space for an operator for clearing a paper jam in the feeding means, the hatch may extend along at least a major portion of the axial extension of the drive roller. The hatch may, for instance, extend in a transverse direction across the front wall at least up to the side walls of the second housing. The extension at right angles to the transverse direction, in the local plane of the front surface of the hatch, is selected to allow access to those parts of the drive roller, pressure roller and cutting device making up the feeding mechanism where a paper jam may occur. Hence, the plane of the hatch may be located in at least a front surface of the second housing, but may also extend into one or both side surfaces and/or a lower edge or surface of the second housing.

The second housing may comprise a casing or cassette that can be attached to the chassis, wherein the hatch is mounted on the said second housing behind the cover. Hence the cover, when opened, is arranged to provide access to the hatch. This arrangement facilitates access for servicing and for re-filling of the dispenser with maintained operator safety and protection for the feeding mechanism. With the cover in its open position, the hatch need only be opened to allow service of the feeding mechanism or to clear a paper jam. The hatch may be closed manually prior to the closing of the cover. Alternatively, if the hatch mounted to the second housing by a hinge, the hatch may be closed automatically during the closing of the cover.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
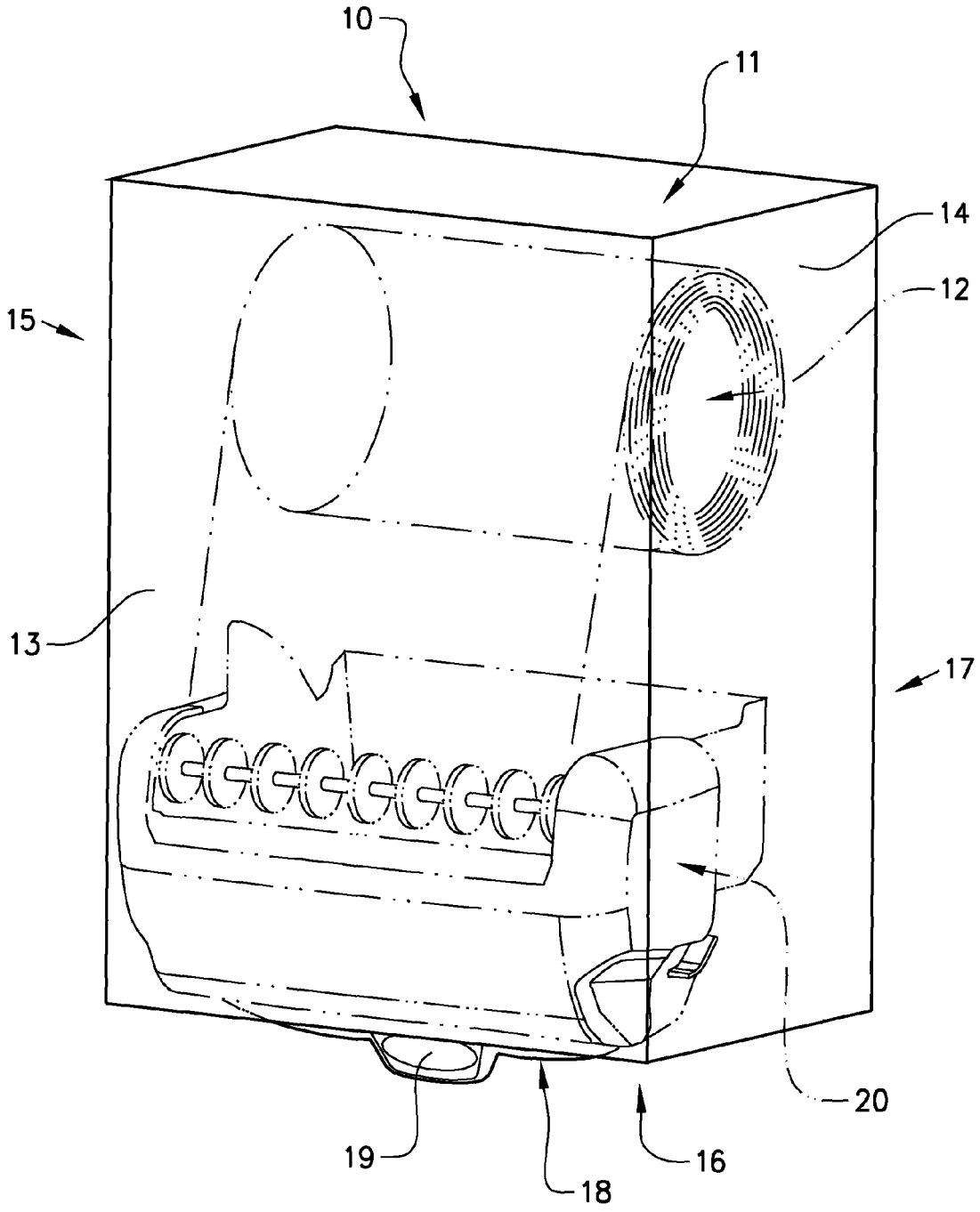
FIG. 1 schematically illustrates a dispenser according to the invention.
Figure 2:
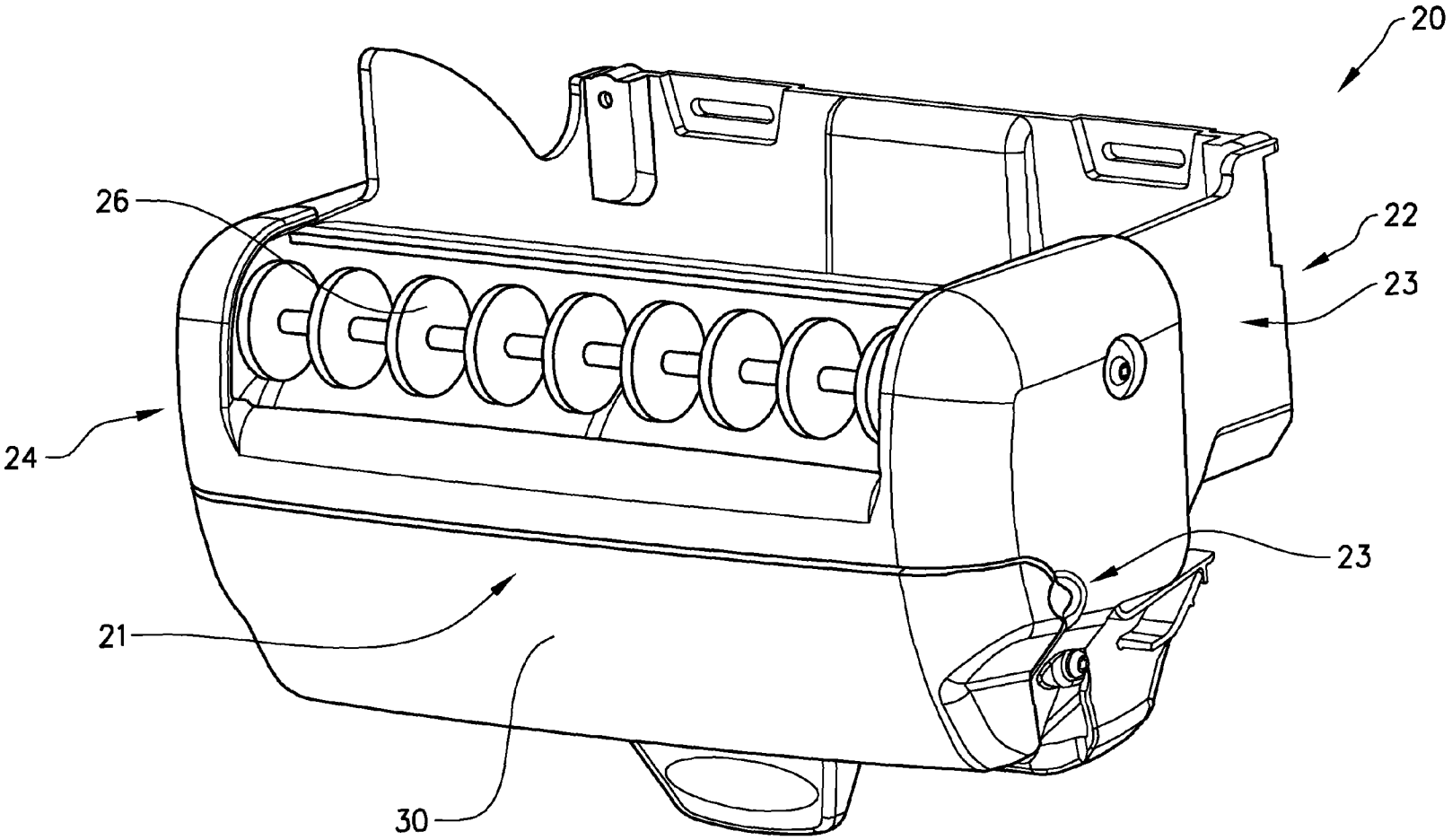
FIG. 2 schematically illustrates a cassette containing a feeding means for use in a dispenser as shown in FIG. 1.

FIG. 1 schematically illustrates a dispenser 10 for dispensing wiping material comprising a first housing 11 for holding a roll 12 containing a continuous web of wiping material. The first housing 11 comprises an outer front wall 13 two outer side walls 14, 15 and a dispensing opening 16 for the web is provided adjacent a lower portion of said outer front wall 13. In this example, the entire visible portion of the first housing 11 forms a cover that can be opened by pivoting the cover outwards and downwards to allow access to the interior of the dispenser during re-filling or servicing thereof. The first housing 11 is attached to a chassis 17 intended for mounting on a wall. The dispenser comprises a feeding means for controlling the dispensing of the web from the roll 12, which feeding means will be described in further detail below. A manually actuated actuating mechanism 18 is operatively connected to the feeding means, wherein the actuating mechanism 18 is actuated by a user applying a force to a handle 19 to dispense a predetermined length of wiping material through the dispensing opening. The handle 19 extends out of a lower portion of the housing 11 adjacent the dispensing opening. The first housing 11 holds an inner, second housing. In this example the inner, second housing is a cassette 20 (indicated in dashed lines) which at least partially encloses the feeding means FIG. 2 schematically illustrates a cassette 20 containing a feeding means for use in a dispenser as shown in FIG. 1. The cassette 20 comprises at least a front wall 21, a rear wall 22 and two side walls 23, 24. The feeding means comprises at least a drive roller 25 (see FIG. 3), a pressure roller 26 and a cutting device (not shown). In this case, the drive roller is a rotary drum 25 provided with a cutting device in the form of a rotary cutter located in an axial slot 27 in the outer peripheral surface of the rotary drum 25. Cutters of this type are commonly known and will not be described in further detail. The web is arranged to be fed from the roll 12 (see FIG. 1) and into the feeding means for subsequent dispensing out of the dispensing opening 16. In addition, the cassette 20 comprises a hatch 30, which hatch, when opened, is arranged to provide access to the feeding means through an opening 31 in the cassette 20. The cassette 20 is attached to the chassis, wherein the hatch 30 is mounted on the said cassette 20 behind the cover. Hence the cover, when opened, is arranged to provide access to the hatch 30.

The hatch 30 is pivotably mounted relative to the front wall 21 of the cassette 20, wherein the said hatch 30 is supported by opposing first and second pivots 32, 33 in first and second side walls 23, 24, respectively, of the cassette 20. The first and second pivots 32, 33 are formed as cylindrical projections extending form opposing side surfaces of the hatch 30. Each of the first and second pivots 32, 33 are arranged to be located in a cooperating recess in each of the first and second side walls 23, 24 of the cassette 20. The hatch 30 is arranged to be pivoted outwards and downwards about a horizontal axis X arranged transversely across the lower edge of the cassette 20. The hatch 30 is held in its closed position by at least one releasable attachment means, in the form of cooperating projections and recesses respectively (not shown), creating a snap-in connection on either side of the hatch 30. A recess for a finger grip 34 is provided on at least one side of the hatch 30 to allow a user to grip an edge of the hatch 30 and release the snap-in connections and open the hatch 30.

In order to provide space for an operator for clearing a paper jam in the feeding means, the hatch should extend at least along the axial extension of the drive roller. The hatch 30 in FIG. 2 extends in a transverse direction across the entire width of the front wall 21 and a predetermined distance into the side walls 23, 24 of the cassette 20. The extension at right angles to the transverse direction, in the local plane of the front surface of the hatch 30, is selected to allow access to those parts of the drive roller 25 and the cutting device covered by the cassette 20 during normal servicing and re-filling of the dispenser.

Figure 3:
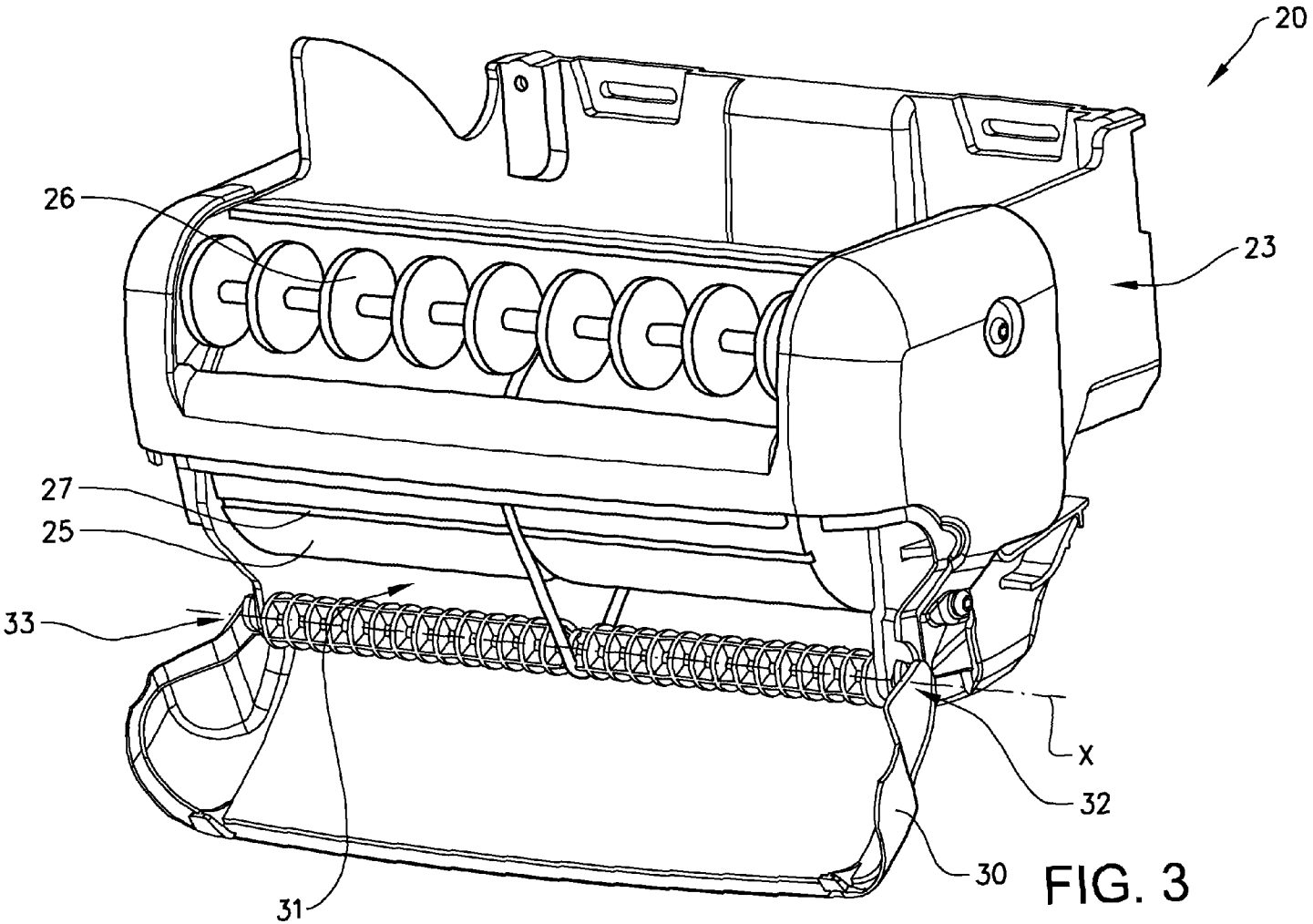
FIG. 3 schematically illustrates the cassette of FIG. 2 with a hatch in its open position.

The arrangement shown in FIGS. 2 and 3 facilitates access for servicing and for re-filling of the dispenser with maintained operator safety and protection for the feeding mechanism. With the cover in its open position, the hatch 30 need only be opened to allow service of the feeding mechanism or to clear a paper jam. The hatch 30 can be closed manually prior to the closing of the cover. Alternatively, the hatch 30 can be designed to cooperate with the cover to be closed automatically during the closing of the cover.

Figure 5:
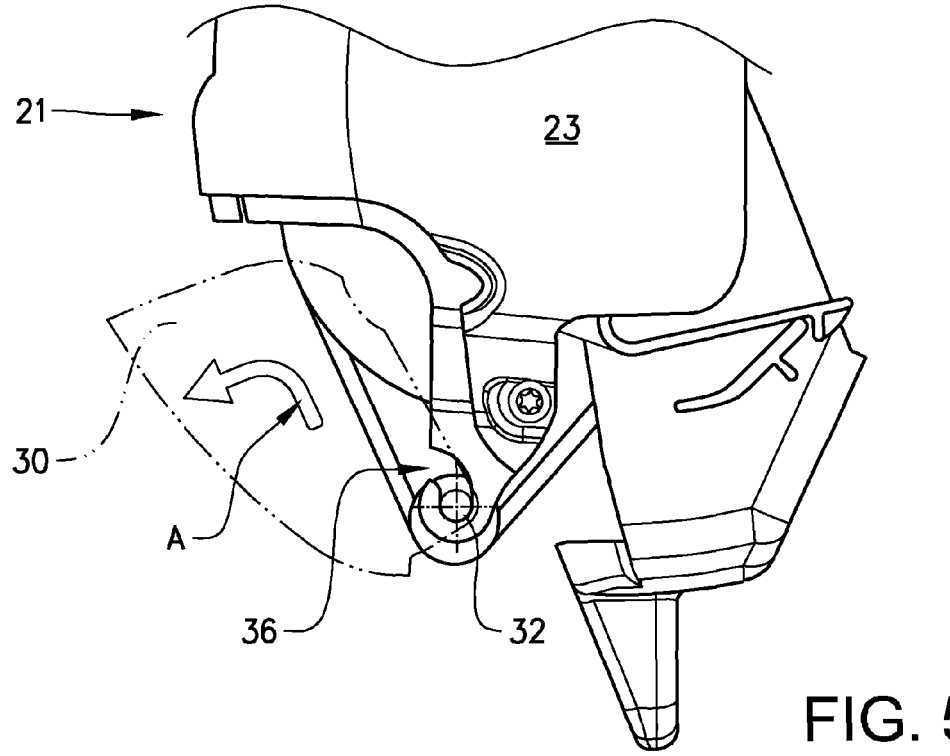
Figure 6:
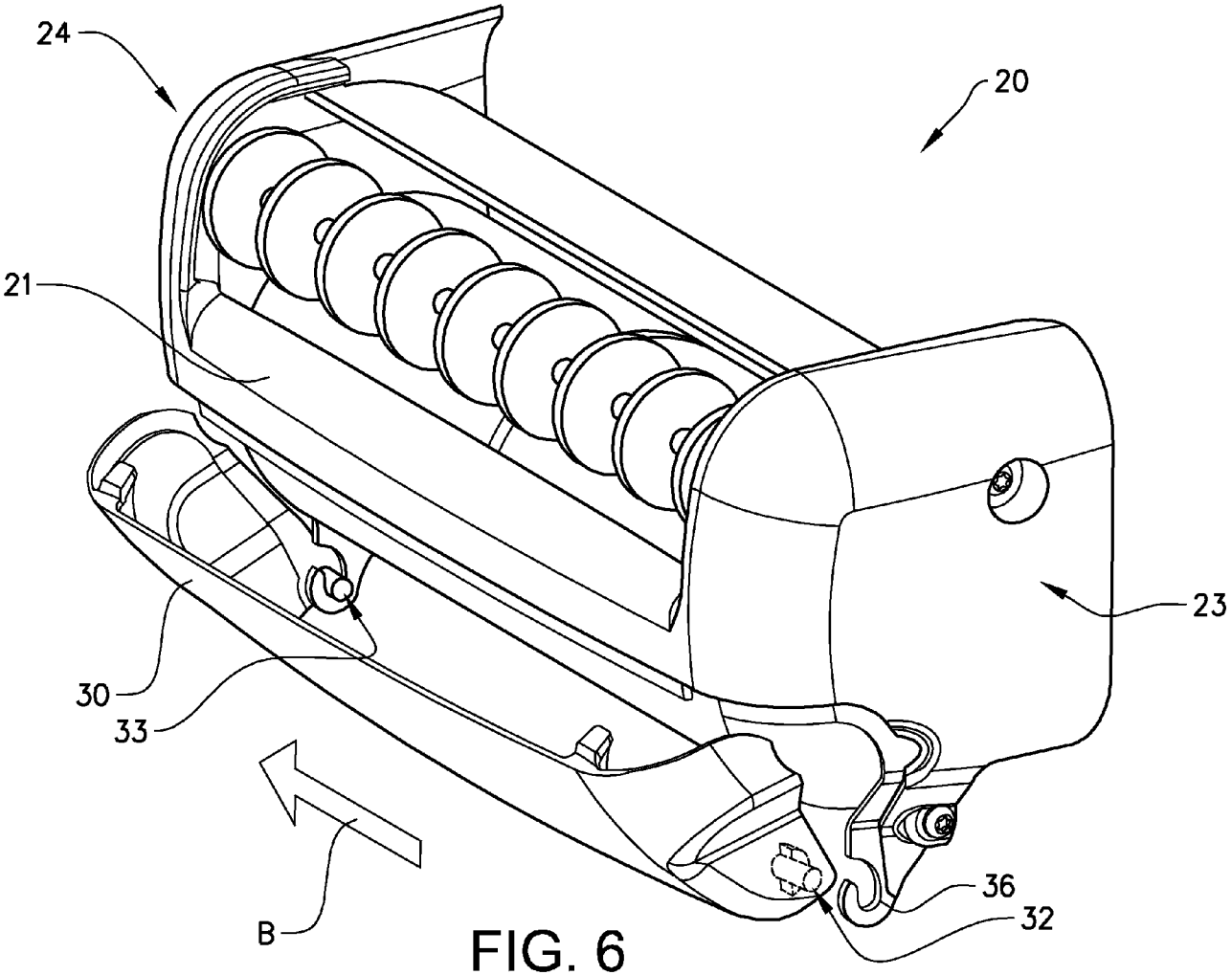

FIG. 3 shows the hatch 30 in its opened position, where the hatch has been completely opened by pivoting it outwards and downwards about the horizontal axis X. In order to further improve access to the feeding mechanism through the opening 31, the hatch 30 can also be entirely removed from the cassette 20. The removal of the hatch 30 from the cassette is illustrated in FIGS. 4-6.

Figure 4:
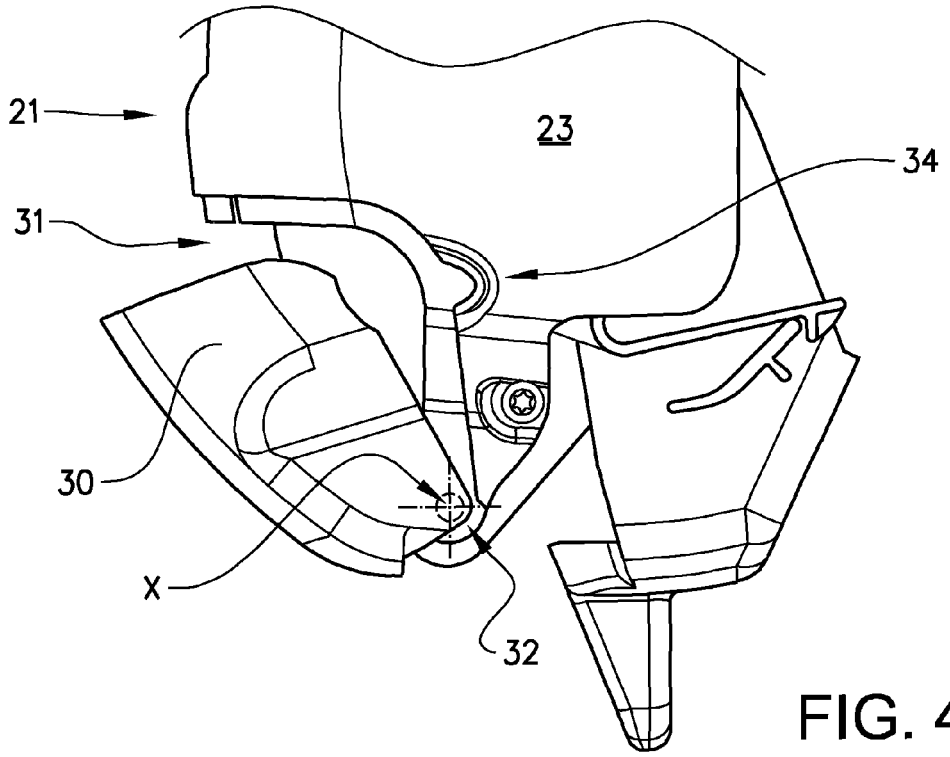
FIGS. 4-6 illustrates the removal of a hatch from cassette as shown in FIGS. 2 and 3.

As shown in FIG. 4, the hatch 30 is first opened a predetermined angle. The hatch 30 shown in FIG. 4 need not be pivoted about the axis X into its opened position. An opening angle of approximately 30°, as indicated in the figure, will be sufficient to allow the hatch to be removed. In FIG. 5 the hatch 30 is indicated in dashed lines, in order to show the location of the first pivot 32 of the hatch 30 placed in a cooperating L-shaped recess 36 in the first side wall 23 of the cassette 20. In order to remove the hatch 30, the end of the hatch shown in FIG. 5 is first displaced vertically upwards and then horizontally outwards, away from the front wall 21 of the cassette 20 and towards the user, as indicated by the arrow A. This displacement releases the end of the hatch 30 adjacent the first side wall 23 from the cassette 20. The hatch 30 is then displaced sideways in the transverse direction of the front wall 21 of the cassette, as indicated by the arrow B in FIG. 6. This displacement releases the opposite end of the hatch 30 from the cassette 20, as the second pivot 33 located opposite the first pivot 32 is moved out of a corresponding circular recess (not shown) in the second side wall 24. The hatch 30 may then be removed to provide improved access to the interior of the cassette 20. In order to re-attach the hatch 30, the steps outlined above are merely performed in reverse order.

Alternatively, the first and second pivots may be projections located on opposite side surfaces of the hatch 30. These projections may cooperate with recesses located in opposing side surfaces of the first and second side walls of the cassette. The recesses can have the same general shape as the L-shaped recess and the cylindrical recess described above. Removal and re-attachment of the hatch will be similar to the example described in connection with FIGS. 4-6 above.

According to a further alternative, both recesses may have an L-shaped section and be arranged to cooperate with opposing or opposite projections on the hatch. Removal and re-attachment of the hatch will be similar to the steps described for release of the first projection, as described in connection with FIG. 5 above. However, in this alternative example both projections would be released substantially simultaneously.

The invention claimed is:

1. A dispenser for dispensing wiping material through a dispensing opening, comprising:

an outer, first housing for holding at least one roll containing a continuous web of wiping material;

said first housing comprising a chassis, an outer front wall, two outer side walls and an at least partially removable cover;

said cover, when opened, being arranged to provide access to said at least one roll;

said first housing further holding an inner cassette comprising at least a front wall and two side walls;

said cassette at least partially enclosing a feeding unit for controlling the dispensing of the web;

said feeding unit comprising at least a drive roller, a pressure roller and a cutting device and the web being arranged to be fed from the roll and into the feeding unit;

said cassette comprising an at least partially removable hatch;

said hatch, when opened, being arranged to provide access to the feeding unit; and said hatch being pivotably mounted relative to the front wall of the cassette;

wherein said hatch is supported by pivots in the side walls of the cassette, said pivots being releasable from the side walls of the cassette.

2. The dispenser according to claim 1, wherein the pivots are sequentially releasable from the side walls of the cassette.

3. The dispenser according to claim 1, wherein the pivots are simultaneously releasable from the side walls of the cassette.

4. The dispenser according to claim 1, wherein the hatch is held in its closed position by at least one releasable attachment means.

5. The dispenser according to claim 1, wherein the cover is arranged to close the hatch when moved from its open to its closed position.

6. The dispenser according to claim 1, wherein the hatch is attached to the cassette by one or more releasable snap-in connectors.

7. The dispenser according to claim 6, wherein the hatch is mounted by snap-in connectors in opposing recesses of the side walls of the cassette.

8. The dispenser according to claim 1, wherein the hatch extends along at least a major portion of the axial extension of the drive roller.

9. The dispenser according to claim 1, wherein the hatch extends in a transverse direction across the front wall at least up to the side walls of the cassette.

10. The dispenser according to claim 1, wherein the hatch is arranged adjacent a nip between the drive roller and the pressure roller.

11. The dispenser according to claim 1, wherein the cover, when opened, is arranged to provide access to the hatch.

12. A dispenser for dispensing wiping material through a dispensing opening, comprising:

an outer, first housing for holding at least one roll containing a continuous web of wiping material;

said first housing comprising a chassis, an outer front wall, two outer side walls and an at least partially removable cover;

said cover, when opened, being arranged to provide access to said at least one roll;

said first housing further holding an inner cassette comprising at least a front wall and two side walls;

said cassette at least partially enclosing a feeding unit for controlling the dispensing of the web;

said feeding unit comprising at least a drive roller, a pressure roller and a cutting device and the web being arranged to be fed from the roll and into the feeding unit;

said cassette comprising an at least partially removable hatch;

said hatch, when opened, being arranged to provide access to the feeding unit; and said hatch being pivotably mounted relative to the front wall of the cassette, wherein the hatch is held in its closed position by at least one releasable attachment means.

13. The dispenser according to claim 12, wherein the hatch is supported by pivots in the side walls of the cassette.

14. The dispenser according to claim 13, wherein the pivots are releasable from the side walls of the cassette.

15. The dispenser according to claim 14, wherein the pivots are sequentially releasable from the side walls of the cassette.

16. The dispenser according to claim 14, wherein the pivots are simultaneously releasable from the side walls of the cassette.

17. The dispenser according to claim 12, wherein the cover is arranged to close the hatch when moved from its open to its closed position.

18. The dispenser according to claim 12, wherein the hatch is attached to the cassette by one or more releasable snap-in connectors.

19. The dispenser according to claim 18, wherein the hatch is mounted by snap-in connectors in opposing recesses of the side walls of the cassette.

20. The dispenser according to claim 12, wherein the hatch is arranged adjacent a nip between the drive roller and the pressure roller.

* * * * *